United States Patent [19]

Davis et al.

[11] 4,045,267

[45] Aug. 30, 1977

[54] METHOD AND APPARATUS FOR TACKING A HONEYCOMB CORE TO A BASE SHEET

[75] Inventors: Bernard H. Davis, Stoney Creek, Canada; Rollin T. Mack; Kenneth Miyasaki, both of Stockton, Calif.

[73] Assignee: H. H. Robertson Company, Pittsburgh, Pa.

[21] Appl. No.: 660,013

[22] Filed: Feb. 23, 1976

[51] Int. Cl.[2] ..... B31D 3/02

[52] U.S. Cl. ..... 156/197; 156/292; 156/311; 156/324; 156/498; 156/549

[58] Field of Search ..... 156/324, 311, 292, 495, 156/197, 498, 306, 495, 548-549; 428/116, 117-118, 73; 264/164; 62/63, 64; 228/181

[56] References Cited

U.S. PATENT DOCUMENTS

| | | | |
|---|---|---|---|
| 2,502,304 | 3/1950 | Baker | 264/164 |
| 2,722,735 | 11/1955 | Beamish | 156/197 UX |
| 2,951,004 | 8/1960 | Martin et al. | 428/116 X |
| 3,067,586 | 12/1962 | Offen | 62/63 |
| 3,115,756 | 12/1963 | Overbye | 62/63 X |
| 3,756,884 | 9/1973 | Hagino | 156/498 X |
| 3,769,131 | 10/1973 | Genson | 156/498 X |

*Primary Examiner*—David A. Simmons

*Attorney, Agent, or Firm*—Harry B. Keck; George E. Manias

[57] ABSTRACT

A method of tacking a honeycomb core to a base sheet, the core member having coatings of adhesive, one provided on the ends of the cells of each face of the core. The core is engaged with the base sheet so that one coating of adhesive contacts the base sheet while moving the core and the base sheet as a unit along a rectilinear path of travel. While engaging the core with the base sheet, the base sheet is (a) heated to temperatures within a wetting temperature of the adhesive but below the curing temperature of the adhesive, (b) maintained at temperatures within said wetting temperature range for a time sufficient to allow the one coating of adhesive to be heated, to flow and to form a fillet between the base sheet and the core but insufficient to allow undue heating of the other coating of adhesive, and (c) the base sheet, the adhesive, and the core are rapidly cooled to a discharge temperature which is below the wetting temperature range of the adhesive, thereby to tack the core to the base sheet. To promote adhesion, the base sheet and the one coating of adhesive are quenched, immediately following the heating step, to precipitously reduce the temperature thereof to temperatures just below the wetting temperature range but above the discharge temperature. Apparatus is described for tacking a honeycomb core to a base sheet.

17 Claims, 16 Drawing Figures

HEATING
QUENCHING
COOLING
TIME
BASE SHEET TEMPERATURE
A
B
C
D

METHOD AND APPARATUS FOR TACKING A HONEYCOMB CORE TO A BASE SHEET

BACKGROUND OF THE INVENTION

1. Field of the Invention:

This invention relates to a method and apparatus for tacking a honeycomb core to a base sheet.

2. Description of the Prior Art:

Structural panels are known wherein the facing sheets are bonded to the opposite faces of a honeycomb core by glue layers. See U.S. Pat. Nos. 2,556,470 (DEL MAR); 2,839,442 (WHITTAKER); 2,849,758 (PLUMLEY et al); 2,893,076 (HERTS); 2,911,076 (SAUNDERS et al); 3,817,810 (RONAN et al); and copending applications serial number 601,296 filed Aug. 4, 1975 and now U.S. Pat. No. 3,998,024 and Ser. No. 601,342 filed Aug. 4, 1975 and now U.S. Pat. No. 3,998,023, both assigned to the assignee of the present invention.

SUMMARY OF THE INVENTION

The principal object of this invention is to provide a method for tacking a honeycomb core to a base sheet and apparatus for practicing the method.

Another object of this invention is to provide a reliable temporary adhesive bond between all edges of one face of the core and the base sheet, whereby all cells of the honeycomb core are substantially entirely capped by the base sheet.

Still another object of the present invention is to provide a method of reliably tacking a honeycomb core to a base sheet even though the base sheet exhibits a phenomenon known as "oilcanning".

In accordance with the present invention, an improved method is provided for tacking an expanded core member having plural open-ended cells to a base sheet, the core member having coatings of adhesive one provided on the ends of the cells on each face of the core. The method comprises the steps of engaging the core member with the base sheet so that one coating of adhesive contacts the base sheet while moving the base sheet and the core member as a unit along a rectilinear path of travel; while engaging the base sheet with the core member, (a) heating the base sheet to temperatures above a wetting temperature range of the adhesive, the wetting temperature range being below the curing temperature of the adhesive, (b) maintaining the base sheet at temperatures within said wetting temperature range until the one coating of adhesive is heated, flows, and forms a fillet between the core member and the base sheet, and (c) cooling the base sheet and the one coating of adhesive to a discharge temperature which is below the wetting temperature range of the adhesive, thereby to tack the core member to the base sheet. Further in accordance with the present invention, the method includes, prior to cooling, the step of quenching the base sheet to achieve a rapid reduction in the temperature thereof to a temperature just below the wetting temperature range of the adhesive but above the discharge temperature.

Still further in accordance with the present invention, apparatus is provided for tacking an expanded core member to a base sheet. The apparatus comprises retaining conveyor means retaining the core member engaged with the base sheet so that the one coating of adhesive contacts the base sheet and moving the base sheet and the core member along a rectilinear path of travel.

Heating means positioned along the clamping conveyor means is provided for heating the base sheet to temperatures within the wetting temperature range and for maintaining the base sheet at the temperatures within the wetting temperature range for a selected time interval during which the adhesive is heated, flows and forms a fillet between the core member and the base sheet. Cooling means positioned along the retaining conveyor means and downstream of the heating means is provided for cooling the base sheet and the one coating of adhesive to a discharge temperature which is below the wetting temperature range of the adhesive, thereby tacking the core member to the base sheet. The present apparatus also includes quenching means positioned between the heating means and the cooling means for rapidly reducing the temperature of the base sheet to a temperature just below the wetting temperature range of the adhesive but above the discharge temperature.

Figure 1:
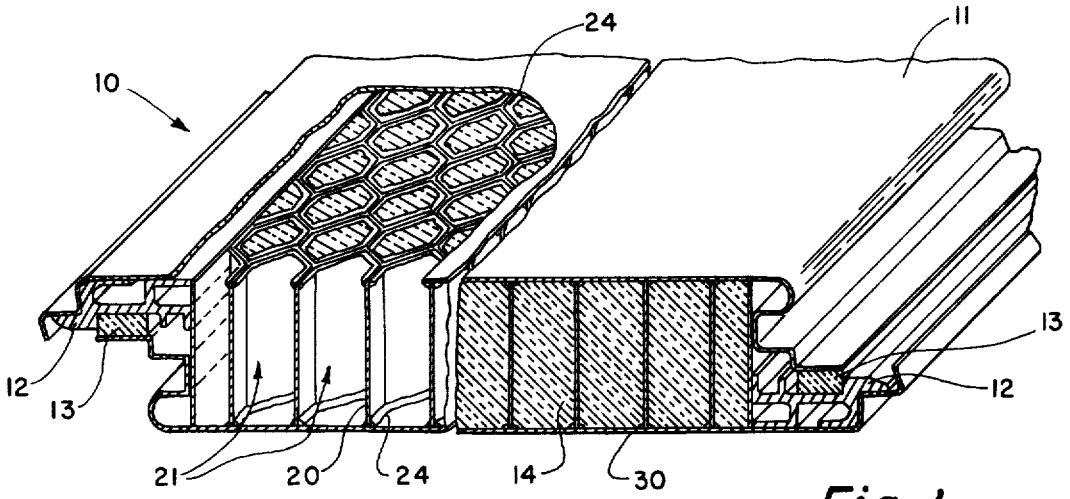
FIG. 1 is a broken, fragmentary isometric view of a building panel.
Figures 3, 4, 5, 6:
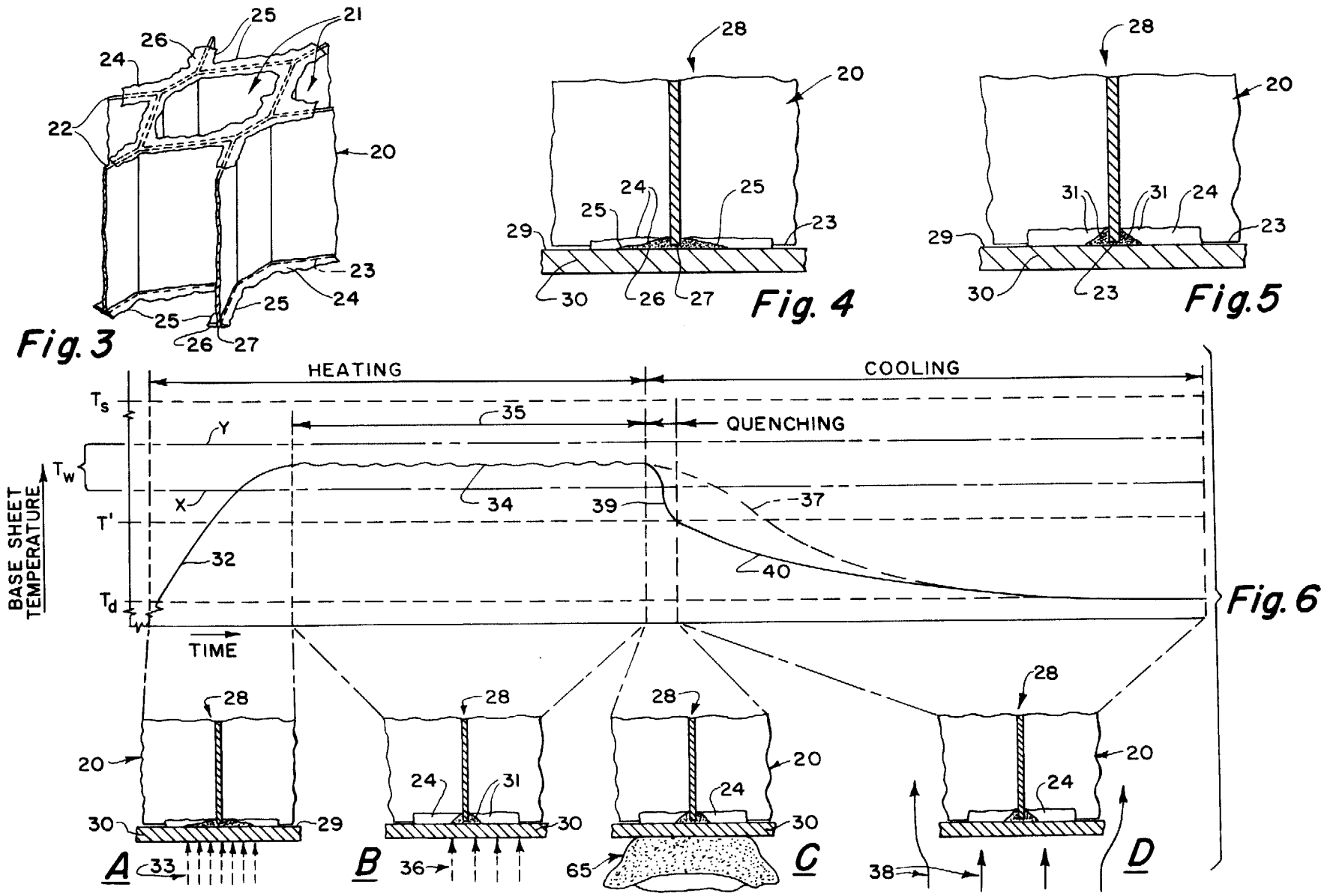
Figure 7:
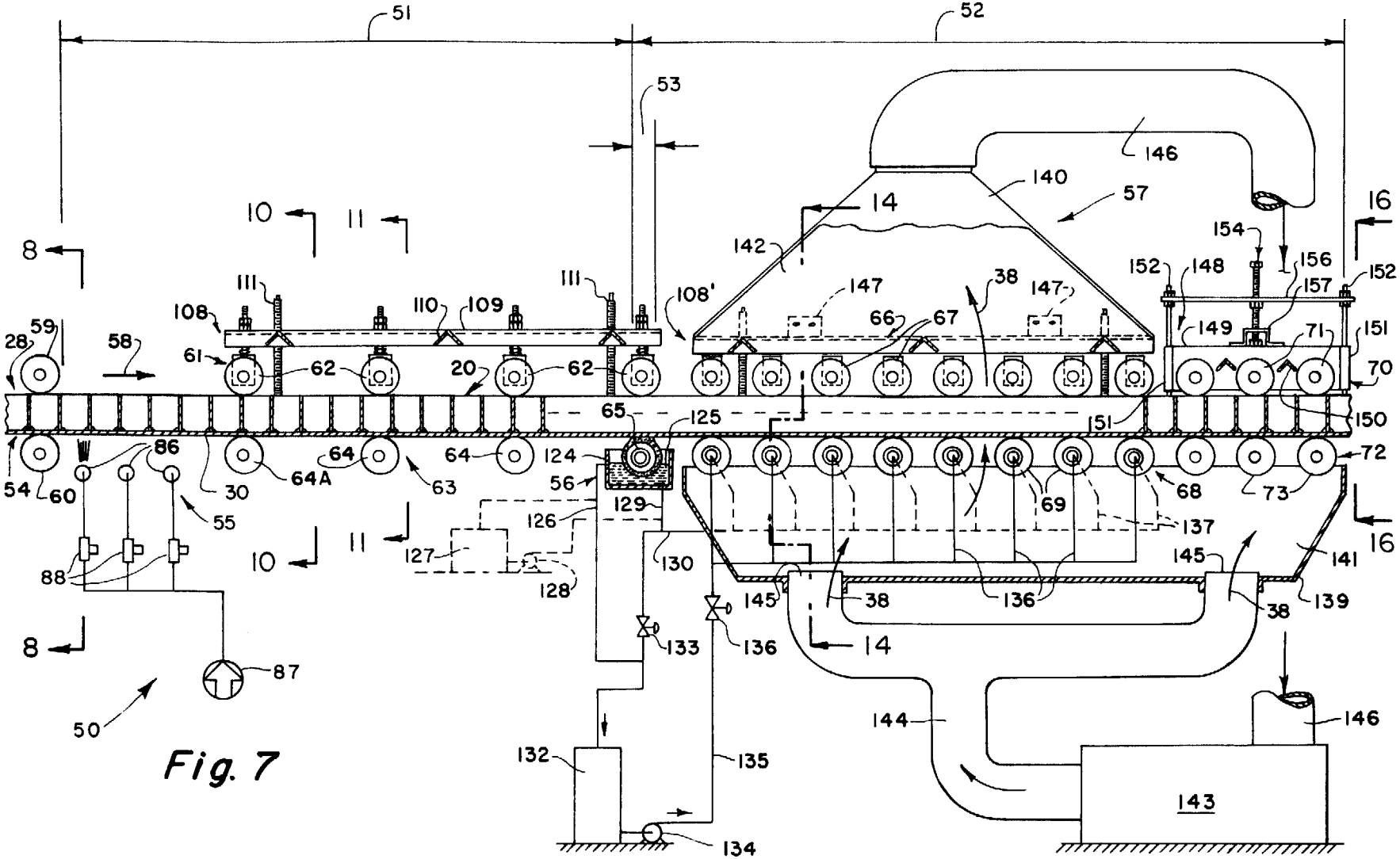
Figure 8:
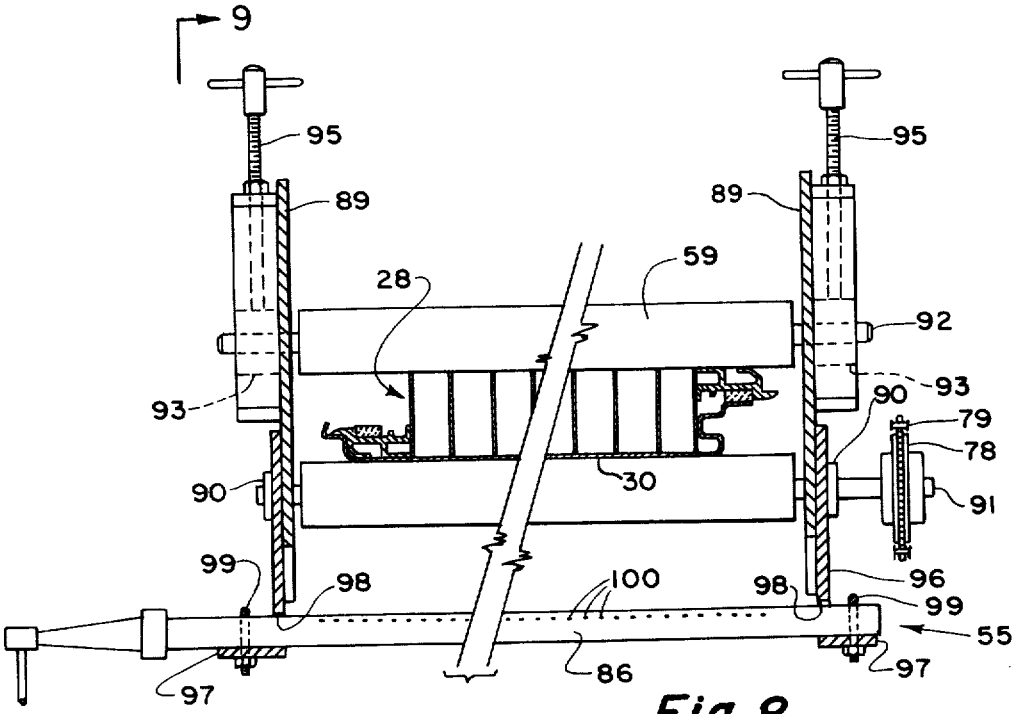
Figure 9:
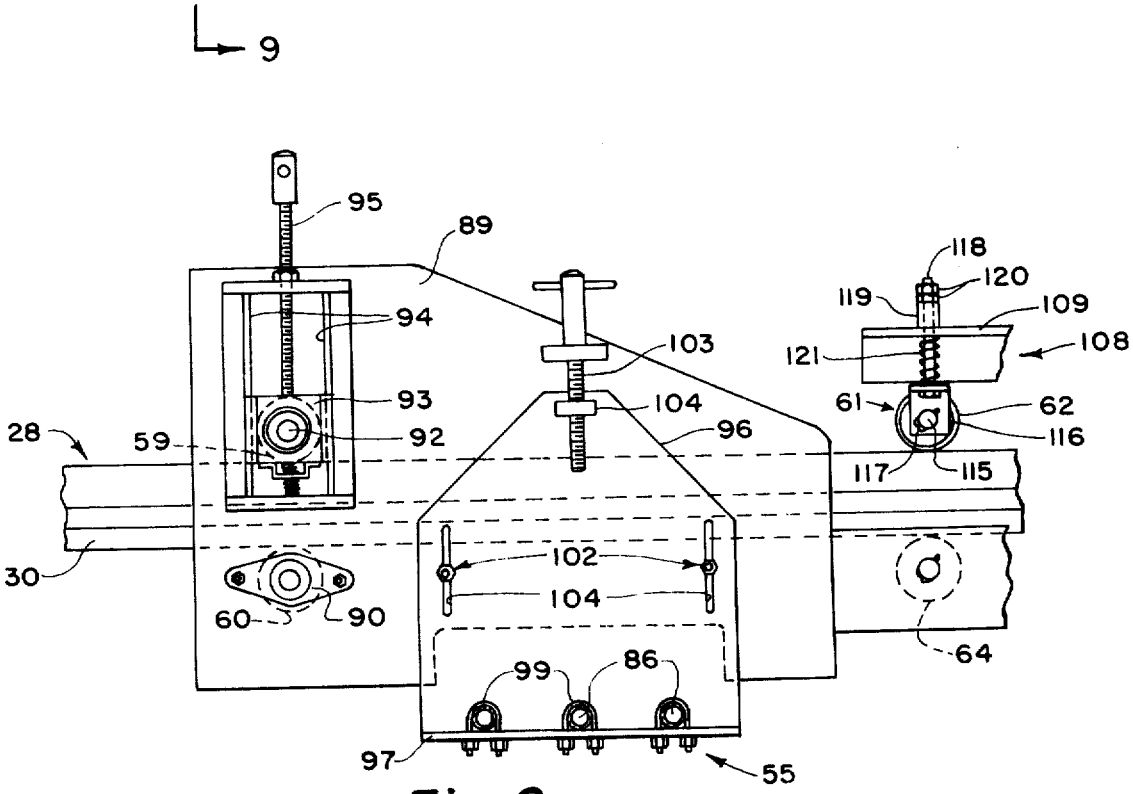
Figure 10:
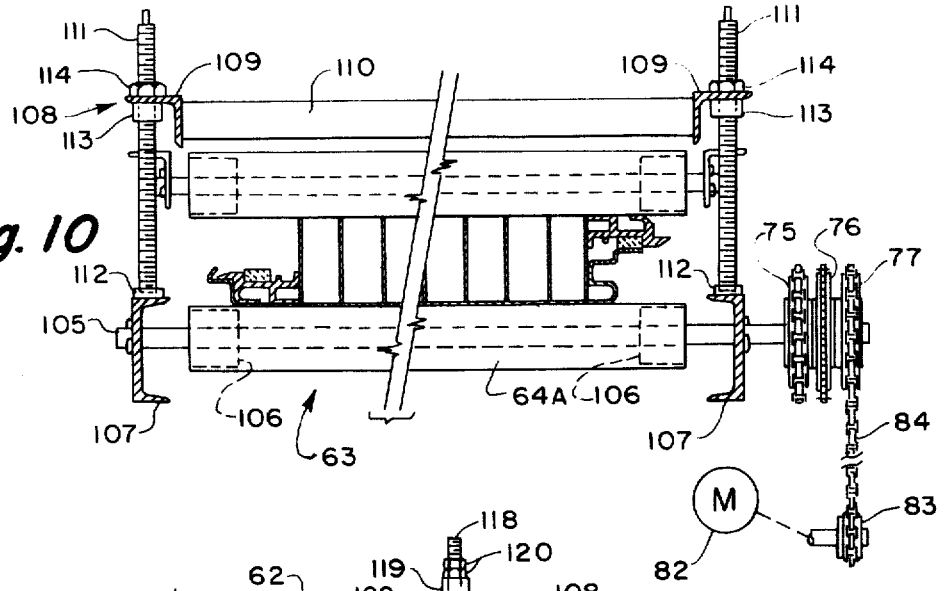
Figure 11:
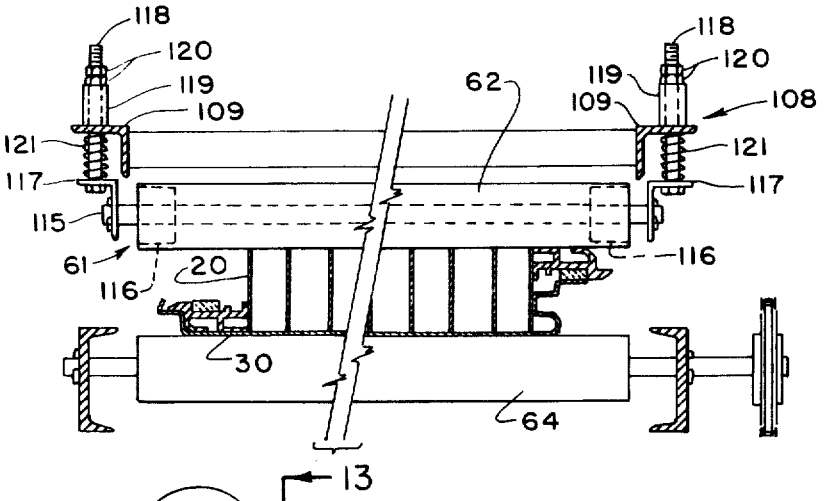
Figure 12:
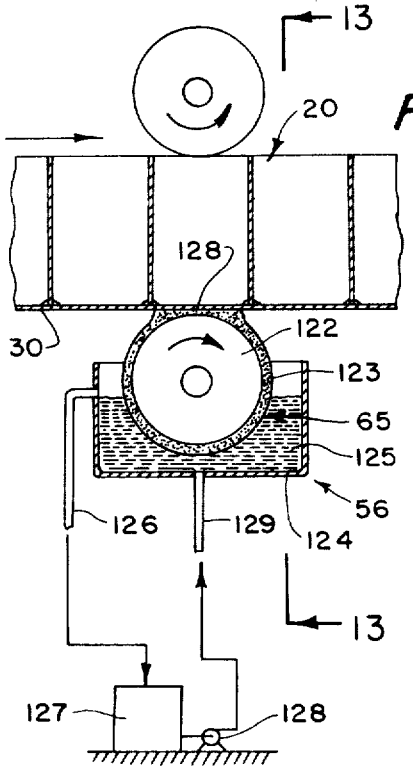
Figure 13:
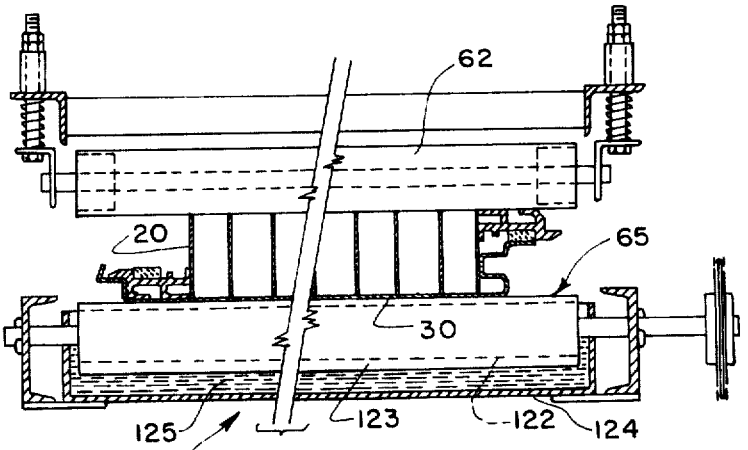
Figure 14:
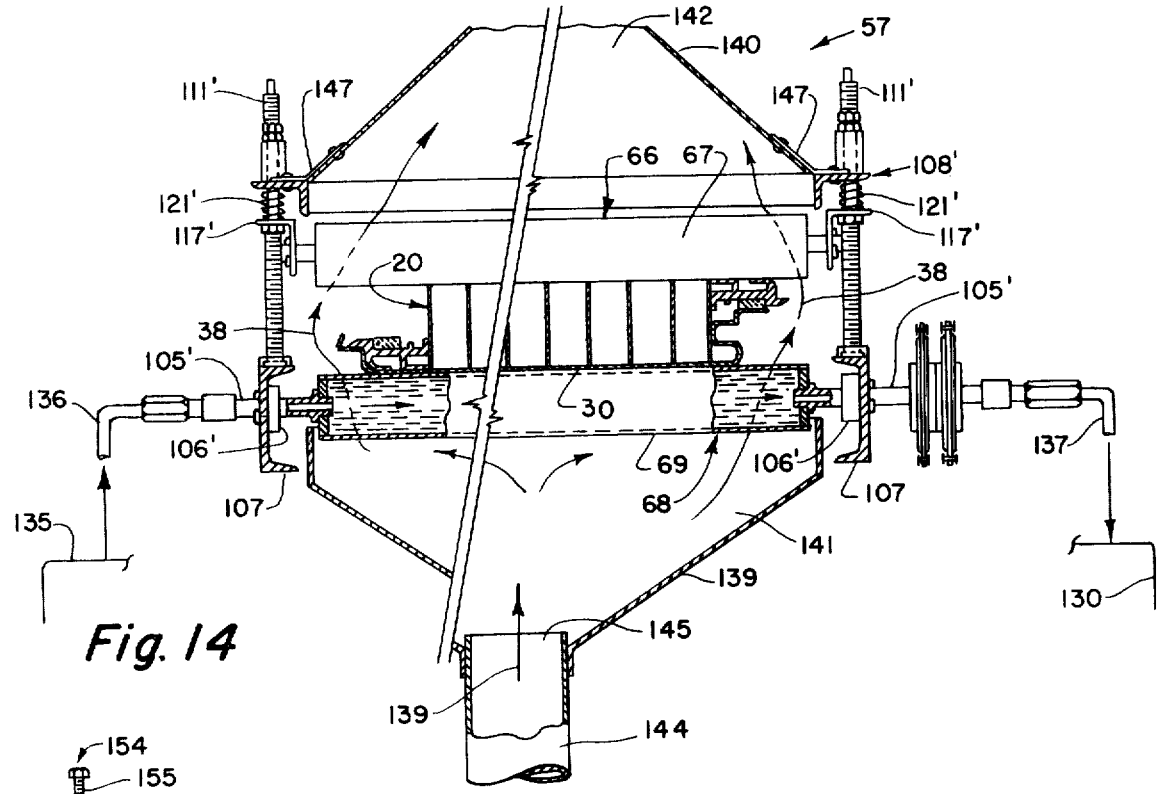
Figure 16:
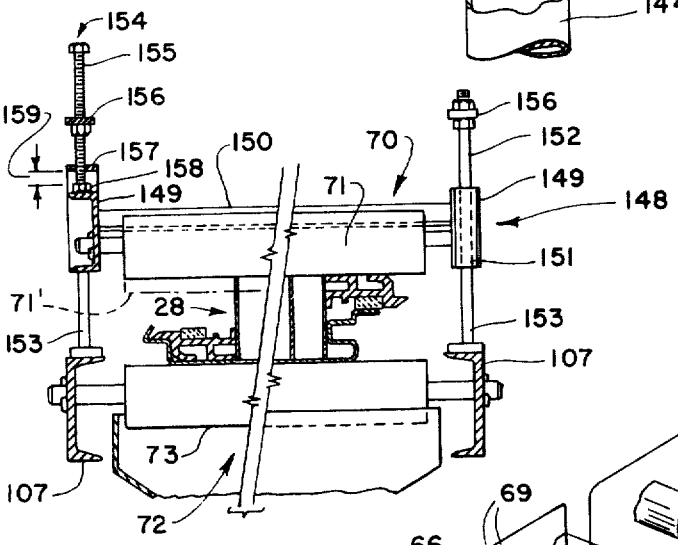
Figure 15:
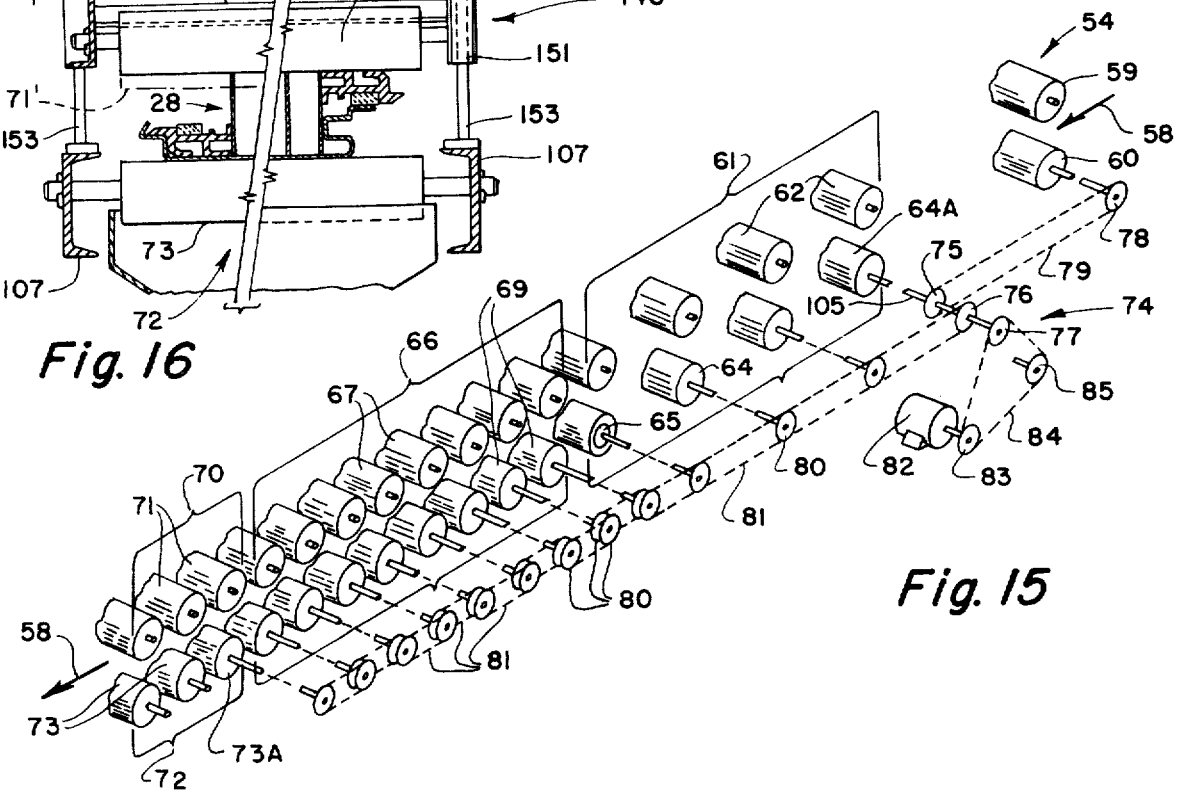

FIG . 2 is a diagrammatic illustration of a method of fabricating the panel of FIG. 1;

FIG. 3 is a fragmentary isometric view of a honeycomb core having a film of adhesive applied to each of the opposite faces thereof;

FIG. 4 is a fragmentary vertical cross-sectional view of the honeycomb core positioned on a base sheet, prior to heating;

FIG. 5 is a fragmentary cross-sectional view of the honeycomb core and the base sheet of FIG. 4, illustrating the filleting of the film of adhesive after heating;

FIG. 6 is a presentation of graphical information and related fragmentary cross-sectional views, which schematically illustrate the method of this invention;

FIG. 7 is a vertical cross-sectional view illustrating the sequential zones of apparatus of performing the method of this invention;

FIG. 8 is a broken cross-sectional view taken along the line 8—8 of FIG. 7;

FIG. 9 is a fragmentary cross-sectional view taken along the line 9—9 of FIG. 8;

FIG. 10 is a broken cross-sectional view taken along the line 10—10 of FIG. 7;

FIG. 11 is a broken cross-sectional view taken along the line 11—11 of FIG. 7;

FIG. 12 is a fragmentary vertical cross-sectional view illustrating quenching means employed in the apparatus of FIG. 7;

FIG. 13 is a broken cross-sectional view taken along the line 13—13 of FIG. 12;

FIG. 14 is a broken, fragmentary cross-sectional view taken along the line 14—14 of FIG. 7;

FIG. 15 is a fragmentary isometric view schematically illustrating drive means for retaining conveyor means utilized in the apparatus of FIG. 7; and FIG. 16 is an end view, partly in cross-section, as viewed from the line 16—16 of FIG. 7.

DESCRIPTION OF THE PREFERRED EMBODIMENT(S)

FIG. 1 illustrates a panel 10 comprising a base sheet 30; a honeycomb core 20 having plural open-ended cells 21 and having a coating 24 of adhesive material applied to the ends of the cells 21 on both faces of the honeycomb core 20; and a top or facing sheet 11. Each of the sheets 30, 11 is provided with a side rail 12 and an isolation strip 13 interposed between the side rail 12 and the adjacent sheet. The isolation strip 13 thermally insulates the facing sheets from each other. The panel 10 also includes granular insulation 14 deposited in the cells 21 of the honeycomb core member 20.

Figure 2:
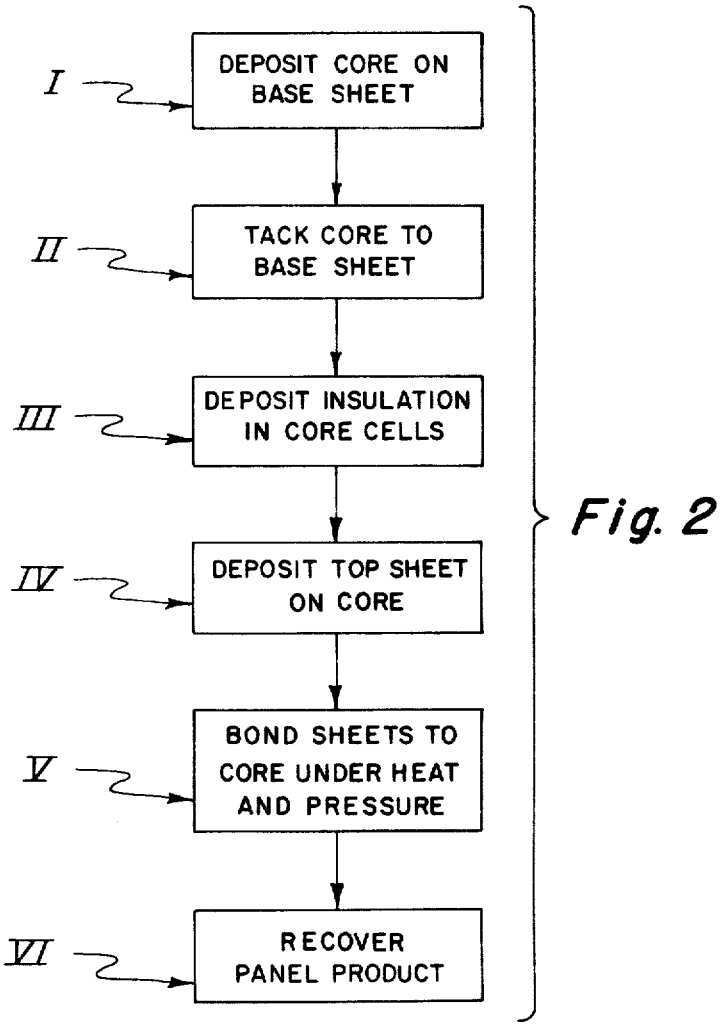

A method for manufacturing the panel 10 is diagrammatically illustrated in FIG. 2. The method includes the steps of I. Depositing the honeycomb core 20 on the base sheet 30 so that the film 24 of adhesive contacts the base sheet 30; II. Tacking the honeycomb core 20 to the base sheet 30; III. Depositing insulation 14 into the core cells 21; IV. Depositing the top sheet 11 on the core member 20 thereby capping the cells 21 thereof; V. Bonding (curing the films 24 of adhesive material) the sheets 30, 11 to the core member 20 under heat and pressure; and VI. Thereafter recovering the panel 10 as a product.

The soundness and extent of the adhesive bonds between the core 20 and the facing sheets 30, 11 affect the structural integrity of the building panel 10. Where less than all of the core edges are bonded to the facing sheets 30, 11, the structural effectiveness of the building panel 10 is impaired.

The facing sheets 30, 11 may take the form of light gauge sheet metal elements having a selected profile. Such elements are fabricated from light gauge sheet metal stock material by roll-forming operations. Where the light gauge sheet metal stock material has unrelieved internal stresses, the roll-forming operation produces a condition known as 37 oilcanning". "Oilcanning" is exhibited in the facing sheet as undulations in areas of the sheet metal element which should be substantially flat.

The oilcanning may prevent tacking the core to the base sheet and ultimately interfere with the final cure of the coating of adhesive. For example, in the oilcanned areas of the facing sheet, the adhesive coated ends of the cells may, after the tacking operation, become disengaged from the base sheet surface. After the insulation is introduced into the core cells, any portion of the insulation which is presented between the adhesive and the base sheet will preclude a reliable final bond therebetween.

The present invention provides an improved method for tacking a honeycomb core to a base sheet, and apparatus for practicing the method.

The honeycomb core member 20 (FIG. 3) presents plural open-ended cells 21 having upper and lower faying edges 22, 23. The core member 20 may be made from Kraft paper impregnated with a fire-resistant salt and with a phenolic resin — the impregnants rendering the honeycomb core member fire, moisture and fungus resistant.

Each of the upper and lower edges 22, 23 is provided with a coating 24 of adhesive material, such as an epoxy structural adhesive. Epoxy resins form a high strength, water-insoluble adhesive providing reliable structural bond. The preferred adhesive is best described as a "thermoplastic-thermoset structural adhesive". Such an adhesive exhibits thermoplastic behavior below and up to a certain temperature; and exhibits thermosetting behavior above that temperature. An epoxy structural adhesive suitable for this purpose is available commercially under the designation "HP-342" from Hexcel Corporation. After being catalyzed, the "HP-342" adhesive is thermoplastic but only for a time-temperature related interval after which the adhesive becomes thermosetting.

The epoxy resins are available in the form of liquids which are mixed in designated proportions and applied to the edges 22, 23 by a well known roller coating method so as to provide the coating 24 having tapered edges 25 and generally flat outer surfaces 26 (see also FIG. 4). As best shown in FIG. 4, the coating 24 of adhesive material covers, as at 27, the lower edges 23 — the same being true for the upper edges 22 (FIG. 3).

FIGS. 4 and 5 illustrate a fragment of a sandwich 28 comprising the core member 20 positioned so that the film 24 of adhesive material confronts a surface 29 of a base sheet 30; and further illustrate the sandwich 28 before and after processing thereof in accordance with the present method. It will be observed that initially (FIG. 4) the film 24 of adhesive material has the tapered configuration. After processing (FIG. 5), the film 24 of adhesive material is presented as fillets 31 which reliably tack all edges 23 of the core member 20 to the base sheet 30.

FIG. 6 presents graphical information and related cross-sectional views, which schematically illustrate the method of this invention. The graphical information presents a generalized relationship between the base sheet temperature and time (or movement of the sandwich 28 through apparatus hereinafter to be described). The cross-sectional views are related to the graphical information and illustrate schematically the condition of the film 24 of adhesive material.

In the graphical information of FIG. 6, $T_w$ corresponds to a useful wetting temperature range (area between the dash-dot lines X and Y) within which the viscosity of the adhesive material is such that the adhesive material flows to form the fillets 31 (FIG. 5). $T_s$ corresponds to a setting or curing temperature of the adhesive material the setting or curing temperature $T_s$ of the adhesive being well above the wetting temperature range $T_w$.

In accordance with the present method, the core member 20 is engaged, throughout the present process, with the base sheet 30 so that the film 24 of adhesive material contacts the surface 29 of the base sheet 30.

The base sheet 30 is heated from ambient temperature to temperatures within the wetting temperature range $T_w$. During heating, the temperature of the base sheet 30 may follow generally the curve segment 32. The base sheet 30 may be heated by directing heating radiation, represented by the dotted arrows 33 (view A), to the undersurface of the base sheet 30.

The base sheet 30 is then maintained at temperatures represented schematically by the undulating curve segment 34, within the wetting temperature range $T_w$ for a selected time interval represented by the dimension line 35. The time interval 35 is sufficient to allow the film 24 of adhesive material to be heated (attain temperatures within the wetting temperature range $T_w$), to flow, and to form the fillets 31 (view B) between the base sheet 30 and the core member 20. The base sheet 30 may be maintained at the temperatures corresponding to the undulating curve segment 34 by application of heating radiation represented by the dotted arrows 36 (view B).

Thereafter the base sheet 30 and the film 24 of adhesive material are rapidly cooled 40 lower the temperatures thereof to a discharge temperature $T_d$ which is below the wetting temperature range $T_w$. While being rapidly cooled the temperature of the base sheet 30 and the film 24 of adhesive material may follow, for example, the dotted curve segment 37. The rapid cooling may be accomplished by directing a cooling medium, represented by the arrows 38 (view D), to the undersurface of the base sheet 30 and around the sandwich 28. The cooling medium preferably comprises conditioned air of relatively low humidity, whereby undesirable vapor condensation on the sandwich 28 is prevented.

It should be noted that prior to filling the cells with insulation, the temperatures of the base sheet 30 and of the adhesive 24 never correspond to the setting or curing temperature $T_s$. Consequently, after cooling, the adhesive fillets 31 (FIG. 5) comprise substantially entirely uncured adhesive material and yet reliably tack all edges of the core member 20 to the base sheet 30.

Further in accordance with the present invention, cooling of the sandwich 28 may include, immediately following heating thereof, the step of quenching the base sheet 30 to cause a precipitous reduction, generally along the curve segment 39, in the temperature thereof to a temperature T', for example, which is just below the wetting temperature range $T_w$. During quenching, the temperature of the film 24 of adhesive material also is reduced below the wetting temperature range $T_w$, thereby to fix or set the film 24 of adhesive material in the form of the fillets 31. The quenching of the base sheet 30 may be accomplished by contacting a liquid coolant, such as water at a subambient temperature, with the undersurface of the base sheet 30. Applicator means, such as a coolant ladened sponge roller schematically illustrated at 65 (view C) may be employed to apply the liquid coolant to the undersurface of the base sheet 30.

Further reduction in the temperature of the base sheet 30, generally along the curve segment 40, is accomplished by the aforesaid cooling medium 38. It will be appreciated that any coolant liquid which remains on the undersurface of the base sheet 30 is quickly absorbed by the cooling medium 38 (conditioned air of relatively low humidity).

Apparatus for performing the method of this invention will now be described with reference to FIGS. 7 through 16, inclusive.

FIG. 7 illustrates apparatus 50 presenting a heating zone 51 and a cooling zone 52. Within the cooling zone 52 there is provided a quenching zone 53. The apparatus 50 comprises, in general, retaining conveyor means 54 extending throughout the zones 51, 52 and 53; and, in sequence along the retaining conveyor means 54, heating means 55, quenching means 56, and cooling means 57. The retaining conveyor means 54 includes carriage means 108, 108' and 148 for retaining the core member 20 engaged with the base sheet 30. The sandwich 28 shown extending through the retaining conveyor means 54 is movable thereby, in the direction of the arrow 58, sequentially through the heating zone 51 and the cooling zone 52.

RETAINING CONVEYOR MEANS: Referring to FIGS. 7 and 15, the retaining conveyor means 54 includes upper and lower entrance rolls 59, 60 which receive the sandwich 28. Downstream of the entrance rolls 59, 60 there is provided a first upper set 61 of upper rolls 62 supported by the carriage means 108, and directly opposite thereto, a first lower set 63 of lower rolls 64 including applicator means 65 which will hereinafter be described in connection with the quenching means 56. Downstream of the first sets 61, 63, there is provided a second upper set 66 of upper rolls 67, supported by the carriage means 108', and directly opposite thereto a second lower set 68 of lower rolls 69. Still further downstream there is provided a third upper set 70 of upper rolls 71 supported by the carriage means 148, and directly opposed thereto a third lower set of lower rolls 73. The upper rolls 59, 62, 67 and 71 preferably are provided with an anti-stick cover (not illustrated), such as Teflon, to preclude adherence of the warm adhesive material at the upper edges of the core 20.

DRIVE MEANS: As best shown in FIG. 15, drive means 74 is provided which may include coaxially aligned sprockets 75, 76, 77 secured to an axle 105 of the first-in-line lower roll 64A. A sprocket 78 operatively connected with the lower entrance roll 60 is driven by a drive chain 79. The remaining lower rolls 64, 65, 69 and 73A have sprockets 80 operatively associated therewith and driven by drive chains 81. Variable speed motor means 82 presents a drive sprocket 83 connected to the sprocket 77 and an idler sprocket 85, by a drive chain 84. The arrangement is such that the lower rolls 60, 64, 65, 69 and 73A are driven at the desired velocity and such that the sandwich (not shown) moves in the direction of the arrows 58. The lower roll 73A may comprise a magnetic roll which assists in moving the sandwich through the apparatus.

ENTRANCE ROLLS: The upper and lower entrance rolls 59, 60 and the heating means 55 may be conveniently incorporated into a unitary structure illustrated in FIGS. 8 and 9. It will be observed that the upper and lower entrance rolls 59, 60 extend between side plates 89. The lower entrance roll 60 includes an axle 91, the opposite ends of which are rotatably supported on bearings 90, each secured to one of the side plates 89. The lower entrance roll 60 is rotated by the drive chain 79 through sprocket 78, as explained above.

The upper entrance roll 59 includes an axle 92, the opposite ends of which extend through the side plates 89 and are rotatably supported on bearings 93. Each of the bearings 93 is movable vertically between tracks 94 (FIG. 9). Two adjusting rods 95 are provided, one connected to each of the bearings 93. The adjusting rods 95 provide individual vertical adjustment of the bearings 93 for leveling the upper entrance roll 59; and provide vertical adjustment of the upper entrance roll 59 to accommodate sandwiches of different thicknesses.

HEaTING MEANS: The heating means 55 (FIG. 7) includes one or more burners 86, each receiving gas from a source 87 through control valve 88. The heating means 55 (FIGS. 8 and 9) additionally includes slide plates 96, one positioned outboard of each of the side plates 89. Each of the slide plates 96 presents an outwardly extending horizontal flange 97 along the lower end thereof. Each of the burners 86 extends transversely between the slide plates 96 and through openings 98 provided therein. The burners 86 rest on the horizontal flanges 97 and are secured thereto, for example, by U-bolts 99. Each of the burners 86 presents burner apertures 100 capable of directing a flame (not shown) upwardly toward the undersurface of the base sheet 30.

Each of the slide plates 96 is provided with a pair of vertical slots 101 which permit the level of the burners 86 to be adjusted relative to the base sheet 30. Fastening means 102 secures the slide plates 96 in vertically adjusted position. Adjustment of each of the slide plates 96 is facilitated by an adjusting rod 103 threadedly engaged with a block 104 secured to the slide plate 96.

LOWER ROLLS: Referring to FIG. 10, each of the lower rolls 64 (and 65) of the first lower set 63 is rotatably supported on an axle 105 by internal bearings 106.

The opposite ends of the axle 105 extend through and are secured to side frame members 107. The lower rolls 73 (FIG. 16) of the third lower set 72 are likewise rotatably supported.

The lower rolls 69 (FIG. 14) of the second lower set 68 have axle segments 105' extending from the opposite ends thereof and rotatably supported by bearings 106' secured to the side frame members 107.

CARRIAGE MEANS 108: Referring to FIGS. 7 and 10, the first upper set 61 of upper rolls 62 is supported on the carriage means 108 which comprises spaced-apart side members 109 connected by tie members 110. The carriage means 108 is vertically adjustable relative to the side frame members 107 (FIG. 10) by adjusting rods 111. The adjusting rods 111 have their lower ends rotatably retained in keepers 112 mounted on the side frame members 107; and are threadedly engaged with lug s 113 (FIG. 10) secured to the side members 109. The carriage means 108 is locked in the desired vertically adjusted position by nuts 114.

Referring to FIGS. 9 and 11, each of the upper rolls 62 of the first upper set 61 is rotatably mounted on an axle 115 by internal bearings 116. The opposite ends of the axle 115 extend through and are secured to angle segments 117. A bolt 118 extends upwardly through each of the angle segments 117 and the side member 109 of the carriage means 108. A spacer 119 and lock nuts 120 are provided on the threaded rod 118 above the side member 109. A spring member 121 is received on the bolt 118 and is compressed between the angle segment 117 and the side member 109. The overall arrangement is such that the individual upper rolls 62 are biased by the spring members 121 toward the lower rolls 64, thereby maintaining the core member 20 engaged with the base sheet 30.

QUENCHING MEANS: Referring to FIGS. 12 and 13, the quenching means 56 includes applicator means 65 comprising a roll 122 having an absorbent cover 123, such as an open-celled sponge. The quenching means 56 further includes a trough 124 containing a bath 125 of liquid coolant, such as water at a sub-ambient temperature. It will be observed in FIG. 12 that the absorbent cover 123 engages the base sheet 30, as at 128. The applicator means 65 transfers liquid coolant from the bath 125 into direct contact with the undersurface of the base sheet 30. Accordingly, a precipitous reduction (curve segment 39 of FIG. 6) in the temperature of the base sheet 30 (also of the film 24 of adhesive material) is provided by the quenching means 56.

As shown in FIG. 12 — also as shown in dotted outline in FIG. 7 — liquid coolant withdrawn from the bath 125 may be conveyed through conduit means 126 to chiller means 127. Liquid coolant at the desired sub-ambient temperature is withdrawn from the chiller means 127 by pump means 128 and conveyed to the trough 124 through conduit means 129. In this manner, a liquid coolant of the bath 125 is continuously replenished so as to maintain the bath 125 at the desired sub-ambient temperature.

Alternatively, the liquid coolant may, as shown in FIG. 7, be cooled to the desired sub-ambient temperature by utilizing the cooling capacity of the cooling means 57. The liquid coolant is conveyed from the cooling means 57 through conduit means 130 into a coolant reservoir 132. Control valve 133 provided in the conduit means 130 downstream of the inlet conduit 129 introduces flow resistance into the conduit 130 such that an adequate quantity of the liquid coolant flows through the branch conduit 129 into the reservoir 124. Liquid coolant from the quenching means 56 is returned to the coolant reservoir 132 through the outlet conduit 126 which communicates with the conduit 130 at a location downstream of the control valve 133.

The liquid coolant is conveyed from the coolant reservoir 132 by pump means 134 through conduit 135, containing control valve 136, into the cooling means 57. Referring to FIGS. 7 and 14, the liquid coolant is distributed by the conduit 135 through plural branch inlet conduits 136, each communicating with one of the lower rolls 69 of the second lower set 68. As best shown in FIG. 12, the liquid coolant fills each of the rolls 69 and flows therethrough to a branch outlet conduit 137. Reverting to FIG. 7, the branch outlet conduits 137 communicate with the common outlet conduit 130. As will be described, conditioned air, represented by the arrows 38 in FIGS. 7 and 14, flows upwardly around the rolls 69 thereby cooling the same and the liquid coolant therewithin.

COOLING MEANS: Referring still to FIGS. 7 and 14, the cooling means 57 comprises enclosure means including a lower pan 139 and a hood 140 which provide lower and upper chambers 141, 142, respectively, above and below the retaining conveyor means 154. Conditioned air (arrows 38) provided by air conditioning means 143, is conveyed through conduit 144 and is introduced into the pan 139 through one or more inlet openings 145. The conditioned air 138 is distributed within the lower chamber 141 and flows upwardly therefrom around the lower rolls 69 and 73 of the second and third lower sets 68, 72, respectively. The hood 140 captures at least a major portion of the conditioned air 38 and returns the same through return conduit 146 to the air conditioning means 143.

It will be appreciated that the conditioned air 138 flows upwardly through the lower chamber 139 into direct impingement with the undersurface of the base sheet 30, thereby to cool the same to the discharge temperature $T_d$ (FIG. 6). The conditioned air 38, being of relatively low humidity, quickly absorbs any liquid coolant which remains on the base sheet 30 after the quenching means 56. Accordingly, undesirable moisture condensation on the base sheet 30 or the core member 20 is precluded.

CARRIAGE MEANS 108': Reverting to FIG. 14, the upper rolls 67 of the second upper set 66 are supported in a manner similar to that of the upper rolls 62 of the first upper set 61. The arrangement includes a carriage means 108' which is vertically adjustabe by means of the adjusting rods 111'. Each of the upper rolls 67 has its opposite end supported on the angle segments 117' and is biased toward the honeycomb core member 20 by the springs 121'. The hood 140, being secured to the carriage means 108' by brackets 147 (FIGS. 7 and 14) is vertically adjustabe with the carriage means 108'.

CARRIAGE MEANS 148: Referring to FIGS. 7 and 16, the upper rolls 71 of the third upper set 70 are supported on the carriage means 148 which comprises side members 149 maintained in fixed, spaced-apart relation by tie members 150. Guide tubes 151 provided at the opposite ends of each side member 149 are slideable along vertically presented guide rods 152. the guide rods 152 associated with each side member 149 have lower ends 153 (FIG. 16) secured to the frame members 107. Vertica adjustment of the carriage means 148 is provided by adjusting means 154. As best shown in FIG. 16, the adjusting means 154 comprises an adjusting rod 155 extending downwardly through a tie bar 156 having its opposite ends connected to the guide rods 152

(see FIG. 7) and through a clearance opening (not visible) in a hat-shaped element 157 (see FIG. 7) which is secured to the side frame 149. The adjusting rod 154 terminates at its lower end in an enlarged head 158 captively retained within the hat-shaped element 157. It will be observed in FIG. 16 that the enlarged head 158 of the adjusting rod 155 is engaged with the side member 149. In the absence of the sandwich 28, the carriage means 148 resides at a lower level — see the dash-dot outline position of the upper roll 71' — such that the enlarged heads 158 engage the hat-shaped elements 157. Accordingly, the carriage means 148 is movable through a distance indicated at 159 in FIG. 16. The overall arrangement is such that as the sandwich 28 is introduced between the upper and lower rolls 71, 73, the carriage means 148 is displaced upwardly such that the entire weight of the carriage means 148 is applied to the sandwich 28.

EXAMPLE: Honeycomb core material may be successfully tacked to a base sheet utilizing the aforesaid HP-342 adhesive. A suitable film of adhesive material is provided on the edges of the cells on at least one face of the core member by applying the adhesive at a rate of about 0.04 pounds per square foot of area per side of core.

With reference to FIGS. 4 through 7, the coated core member 20 is engaged with the base sheet 30 so that the film 24 of adhesive material contacts the base sheet 30. The base sheet 30 and the core member 18 are introduced, as a sandwich 28, into the retaining conveyor means 54 and moved thereby at a rate of about 12 feet per minute. The retaining conveyor means 54 maintains the base sheet 30 engaged with the core member 18 during movement of thereof through the heating and cooling zones 51, 52 (FIG. 7).

While engaging the base sheet 30 with the core member 18, the base sheet 30 is heated to temperatures within a wetting temperature range $T_w$ of from 155° to 165° F of the film 24 of adhesive material. The base sheet 30 is maintained at temperatures within the aforesaid wetting temperature range $T_w$ for a selected time interval 35 (FIG. 6) of at least 15 seconds. The selected time interval is sufficient to allow the film 24 of adhesive to be heated (attain temperatures within the wetting temperature range $T_w$), to flow, and to form the fillets 31 (view 6B) between the base sheet 30 and the core member 20.

Immediately following heating, the heated base sheet 30 is quenched to achieve a precipitous reduction in the temperature thereof to a temperature T' (FIG. 6) of from 140° to 150° F, i.e., just below the wetting temperature range $T_w$. During the quenching step, the temperature of the film 24 of adhesive material also is reduced below the wetting temperature range $T_w$, thereby to fix or set the film 24 of adhesive material in the form of the fillets 31. The quenching of the base sheet 30 may be accomplished by contacting a liquid coolant, such as water at a sub-ambient temperature of about 55° to 60°F, with the undersurface of the base sheet 30.

Thereafter, the base sheet 30 and the core member 20 are introduced into the cooling zone 52 (FIG. 7) wherein the base sheet 30 and the film 24 of adhesive material are rapidly cooled to lower the temperatures thereof to a discharge temperature $T_d$ of from 105° to 115° F. The rapid cooling is accomplished by directing conditioned air, represented by the arrow 138 (FIG. 7) the underside of the base sheet 30 and around the sandwich 28. The conditioned air temperature is in the range of from 55° to 60° F. The conditioned air is of relatively low humidity, whereby undesirable vapor condensation on the sandwich 28 is precluded.

We claim:

1. In the method of making an insulated panel comprising tacking a base sheet to one face of an expanded core member, said expanded core member having plural open-ended cells and having coatings of adhesive, one provided on the ends of the cells on each face of said core member; filling the cells of said core member with thermal insulation; depositing a facing sheet on the other face of said core member in confronting relation with the coating of adhesive thereon; and curing the coatings of adhesive under pressure and by heating the coatings to the curing temperature of the adhesive, thereby to reliably bond said facing sheet and said base sheet to said core member; the improvement in the step of tacking said base sheet to said core member comprising:

engaging said core member with said sheet so that one said coating of adhesive contacts said base sheet while moving said base sheet and said core member along a rectilinear path of travel; and while engaging said base sheet with said core member, a. heating said base sheet to temperatures within a wetting temperature range of the adhesive, said wetting temperature range being below the curing temperature of said adhesive, b. maintaining said base sheet at temperatures within said wetting temperature range for a time interval sufficient to allow said one said coating of adhesive to be heated to flow, and to form a fillet between said core member and said base sheet, said time interval being insufficient to allow heating of the other said coating of adhesive to temperature within said wetting temperature range, and c. rapidly cooling said base sheet and said one said coating of adhesive and the other coating of adhesive to a discharge temperature below said wetting temperature range, whereby a reliable temporary adhesive bond is formed between the ends of all of the cells and caps the cells on one face of said core member by a reliable temporary adhesive bond.

2. The method of claim 1 wherein said base sheet is heated by directing heating radiation to the undersurface thereof.

3. The method of claim 1 wherein said base sheet is heated by direct inpingement of a gas flame to the undersurface thereof.

4. The method of claim 1 including, prior to cooling, the step of quenching said base sheet to achieve a precipitous reduction in the temperatures of said base sheet and said one said coating of adhesive to temperatures below said wetting temperature range of the adhesive but above said discharge temperature.

5. The method of claim 4 wherein said base sheet is quenched by contacting a liquid coolant with the undersurface of said base sheet.

6. The method of claim 5 wherein said liquid coolant comprises water at a sub-ambient temperature.

7. The method of claim 1 wherein cooling of said base sheet and said adhesive is accomplished by conveying said base sheet and said core member through a confined space, while introducing a cooling medium into said confined space and into direct impingement with the undersurface of said base sheet.

8. The method of claim 7 wherein said cooling medium comprises conditioned air.

9. In the method of making an insulated panel comprising tacking a base sheet to one face of an expanded core member, said expanded core member having plural open-ended cells and having coatings of adhesive, one provided on the ends of the cells on each face of said core member; filling the cells of said core member with thermal insulation; depositing a facing sheet on the other face of said core member in confronting relation with the coating of adhesive thereon; and curing the coatings of adhesive under pressure and by heating the coatings to the curing temperature of the adhesive, thereby to reliably bond said facing sheet and said base sheet to said core member; the improvement in the step of tacking said base sheet to said core member comprising:

engaging said core member with said base sheet so that one said coating of adhesive contacts said base sheet, while moving said base sheet and said core member as a unit along a rectilinear path of travel;

while engaging said base sheet with said core member, a. heating said base sheet to temperatures within a wetting temperature range of the adhesive, said wetting temperature range being below the curing temperature of said adhesive, b. maintaining said base sheet at temperatures within said wetting temperature range for a time interval sufficient to allow said one said coating of adhesive to be heated, to flow, and to form a fillet between said core member and said base sheet, said time interval being insufficient to allow heating of the other said coating of adhesive to temperatures within said wetting temperature range, c. quenching said base sheet to achieve a rapid cooling thereof to a temperature below said wetting temperature range of said one said coating of adhesive, d. conveying said base sheet and said core through a confined space, and e. introducing a cooling medium into said confined space to cool said base sheet and said one said coating of adhesive and the other said coating of adhesive to a discharge temperature, whereby a said base sheet is tacked to the ends of all of the cells and caps the cells on one face of said core member by a reliable temporary adhesive bond.

10. The method of claim 1 wherein the adhesive comprises a thermoplastic-thermoset structural adhesive.

11. The method of claim 1 wherein said reliable temporary adhesive bond comprises substantially uncured adhesive.

12. The method of claim 1 wherein said expanded core member comprises a non-metallic honeycomb core member.

13. The method of claim 1 wherein said thermal insulation comprises granular insulation.

14. The method of claim 9 wherein the adhesive comprises a thermoplastic-thermoset structural adhesive.

15. The method of claim 9 wherein said reliable temporary adhesive bond comprises substantially uncured adhesive.

16. The method of claim 9 wherein said expanded core member comprises a non-metallic honeycomb core member.

17. The method of claim 9 wherein said thermal insulation comprises granular insulation.

* * * * *